United States Patent [19]

Pellinen et al.

[11] Patent Number: 4,903,894

[45] Date of Patent: Feb. 27, 1990

[54] VENTILATION CONTROL PROCEDURE AND VENTILATION CONTROL MEANS

[75] Inventors: Teuvo Pellinen, Kausala; Mertsi Niemelä, Kuusankoski; Erkki Aalto, Kausala, all of Finland

[73] Assignee: Halton Oy, Finland

[21] Appl. No.: 246,664

[22] PCT Filed: Jan. 25, 1988

[86] PCT No.: PCT/FI88/00009

§ 371 Date: Sep. 2, 1988

§ 102(e) Date: Sep. 2, 1988

[87] PCT Pub. No.: WO88/05517

PCT Pub. Date: Jul. 28, 1988

[30] Foreign Application Priority Data

Jan. 27, 1987 [FI] Finland ..... 870361

[51] Int. Cl.[4] ..... F24F 7/04

[52] U.S. Cl. ..... 236/492; 98/42.03; 340/628

[58] Field of Search ..... 236/49 A; 98/42.03, 98/42.15; 340/628, 630; 250/574

[56] References Cited

U.S. PATENT DOCUMENTS

| | | | |
|---|---|---|---|
| 3,566,385 | 2/1971 | Lawson | 250/574 X |
| 3,588,893 | 6/1971 | McCloskey | 340/630 X |
| 3,739,707 | 6/1973 | Knapp | 236/49 A X |
| 3,826,180 | 7/1974 | Hayashi | 98/43 |
| 3,926,101 | 12/1975 | Moss | 98/33 R |
| 4,075,616 | 2/1978 | Rait | 340/630 X |
| 4,488,049 | 12/1984 | Marsocci | 250/574 X |
| 4,765,231 | 8/1988 | Aniello | 98/42.03 X |

FOREIGN PATENT DOCUMENTS

| | | |
|---|---|---|
| 0054680 | 6/1982 | European Pat. Off. . |
| 0116647 | 8/1984 | European Pat. Off. . |
| 0133990 | 3/1985 | European Pat. Off. . |
| 0150888 | 8/1985 | European Pat. Off. . |
| 0151735 | 8/1985 | European Pat. Off. . |
| 0161846 | 11/1985 | European Pat. Off. . |
| 3107766 | 11/1982 | Fed. Rep. of Germany . |
| 1519746 | 2/1968 | France . |
| 379274 | 7/1974 | Sweden . |
| 396831 | 10/1977 | Sweden . |
| 444851 | 4/1983 | Sweden . |

OTHER PUBLICATIONS

Backo Ventillation, Catalog 87, "Utrustning for Luftbehandlung".

*Primary Examiner*—William E. Tapolcai
*Attorney, Agent, or Firm*—Steinberg & Raskin

[57] ABSTRACT

The invention concerns a displacement ventilation control procedure in which the impurity and/or moisture concentration of the air containing impurities which accumulates in the part of the room or hall space above the staying zone and/or their changes and/or their differences are observed and the ventilation of the room or hall space is accordingly controlled. The invention also concerns a ventilation control unit.

15 Claims, 3 Drawing Sheets

VENTILATION CONTROL PROCEDURE AND VENTILATION CONTROL MEANS

BACKGROUND OF THE INVENTION

The present invention concerns a procedure for control of displacement air flow ventilation. The invention also concerns a ventilation control apparatus.

Ventilation control procedures, and apparatus, of the art have heretofore been based, as regards air distribution in the room space, mostly on application of the mixing principle. In recent times the displacement principle has been increasingly adopted; this is a method on the control of which entirely novel requirements are imposed.

In displacement ventilation, two zones are established in the room: a pure, and cooler, zone in the lower part of the room, and an impure, and warmer, zone in the upper part of the room. The impurity content in the upper part of the room may then be even more than twenty times the impurity content in the lower part of the room. It is therefore important to make sure that the impure zone in the upper part of the room does not extend into the staying zone and, above all, that it does not enter the breathing zone.

It has been highly prominent drawback from the viewpoint of operation of any displacement ventilation installation that one has endeavoured to determine the requisite air flow by theoretical calculation and by directing the ventilation similarly as mixing ventilation is directed, which has resulted in poor accuracy as regards the air flows and in difficulties of steering. According to the invention, an entirely new ventilation control procedure and apparatus design have now been created wherein use is made of the feature, typical of displacement ventilation, that there occurs an impurity boundary layer or a sharp impurity gradient.

SUMMARY OF THE INVENTION

As taught by the invention, in the procedure the presence of said boundary layer is indicated in the room space.

When the impure air boundary layer moves past a given room or hall level plane, measuring instruments react on the event and control the ventilation in the room, in a pre-programmed manner.

When for instance smoke accumulates in a room space or hall space, the height of the respective boundary layer and/or the impurity content differentials in the room and/or the impurity concentrations at various levels in the room are indicated, and the ventilation is accordingly controlled.

It is possible, instead of direct measurement of impurity concentration, to measure the impurity concentration indirectly by measuring the humidity of the room air, in which case the measurement is otherwise performed in fully equivalent manner as the direct measurement of impurity concentration.

The procedure of the invention is in its main parts characterized in that the impurity and/or humidity concentration of the air containing impurities which accumulates in the part of the room or hall space above the staying zone and/or their changes and/or their differences are observed and the ventilation of the room or hall space is accordingly controlled. The part above is understood to means that part of the room space which does not belong to the staying zone proper.

The ventilation control means of the invention is in its main parts characterized in that it comprises transmitter means which has been disposed to send out a measuring signal into the room space, said measuring signal being arranged to travel in the air in the room space and part of the measuring signal being arranged to be absorbed by the impurities in the air in the room space, the ventilation of the room space being controlled on the basis of the amount of impurities, in desired manner.

Indication of the impurity concentration is most advantageously accomplished by using for instance an infrared signal. Said indication may also take place by other means, for instance using light-optical observation, or using an ultrasonic signal. As taught by the invention, in the hall space are installed means for indicating the boundary layer, advantageously a measuring transmitter and a corresponding receiver. As taught by the invention, the measuring signal may be sent across the hall space, and advantageously across the upper part of the hall space, to a reflector which reflects the beam further possibly to a second reflector and further to a third, etc., and finally to receiver means, which indicates the ultimate intensity of the ultrasonic signal, for instance. The thicker and more impurity-laden the air, the smaller the fraction of the signal which reaches the receiver means.

As taught by the invention, the measuring event may also be accomplished in the way that only certain impurities and only the occurrence of said certain impurities are indicated. In that case, in one embodiment of the invention, the measuring beam, which is understood to be any kind of radiation, is passed through a correlation cell, for instance through a grey filter, and through sampling means and reference means containing material of the kind which is to be indicated, to a band-pass filter and thence further to a detector which observes the absorption of the signal in the impurities. In said procedure, advantageously, reference signal and measuring signal spectra are formed. By comparing said signal levels, the occurrence of the respective impurities in the air in the hall space is observed. The control electronics and the control means are so adjusted according to the invention that on transgression of a given impurity limit blower and/or control means is activated and/or in another way the ventilation of the room space is controlled, either boosting or reducing the ventilation.

BRIEF DESCRIPTION OF THE DRAWINGS

The invention is described in the following, referring to certain advantageous embodiments of the invention, presented in the figures of the drawings enclosed, yet to which the invention is not meant to be exclusively confined.

In FIG. 1A, the vertical coordinate represents the height h of the room space, and on the horizontal coordinate is plotted the occurrence of impurities c in the room air, as percentages. In FIG. 1B, the horizontal coordinate represents temperature and the vertical coordinate, the height of the room space.

DESCRIPTION OF THE PREFERRED EMBODIMENTS

Figure 1A:
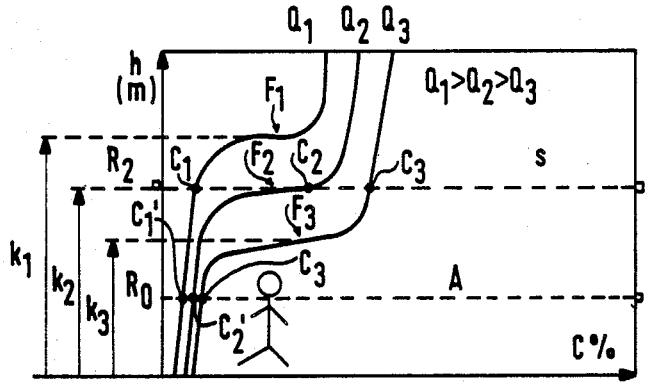
In FIGS. 1A and 1B is presented the measuring principle of the invention. The presentation is schematic.
Figure 1B:
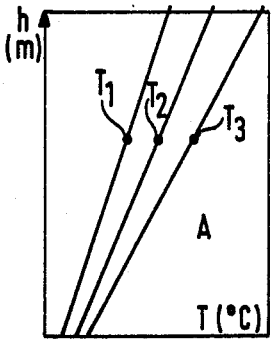

In FIGS. 1A and 1B is illustrated the principle of measurement of the invention, in diagrammatic presentation. The height h in the room is represented by the vertical coordinate, and the occurrence of impurities c is plotted on the horizontal coordinate. The course of temperature in the height direction of the room has also been shown in the figure, in vertical coordinates. A first case is identified with subscripts 1 and a second event with subscripts 2, and third with subscripts 3.

When in case 1 the temperature $\Delta t$ in the upper part of the room space is e.g. 24° C. and the temperature in the staying zone is e.g. 20° C., the differential temperature in case 1 between the staying zone and the upper room space is 4°. In case 2 the temperature is higher in the upper part of the room space. From the graphic presentation in the figure, the distribution of impurity particles at various heights in the room is seen. At the same time one may note on comparison of cases 1 and 2 that the impurity concentration and the per cent occurrence of impurities at various heights in the room also increase with increasing differential temperature. In frequent instances one may notice e.g. in the case of welding halls a distinct impurity zone adjacent to the ceiling of the hall, and a distinct boundary can be seen between said zone and the staying zone. The higher $\Delta t$, the lower is the position of the pure/impure air boundary layer. Thus when $\Delta t$ increases, the ventilation should also increase in order that the impurity zone in the upper part of the hall space might not extend as far as to the staying zone. In the graphic presentation of the figure, the air quantity entering the room and to be removed has been indicated with $Q_1$ in the first case considered, with $Q_2$ in the second case considered, and with $Q_3$ in the third case considered.

It is seen in FIG. 1 how the impurity concentration changes with the height of the hall space. Three cases have been depicted in the figure. The air flow is $Q_1$ in the first case, $Q_2$ in the second case and $Q_3$ in the third case. $Q_1$ is greater than $Q_2$, and $Q_2$ is greater than $Q_3$. Thus, the air flow rate differences in the control may be quite small, yet in the impurity concentration, and particularly in the height of the boundary layer (heights $k_1$, $K_2$, $k_3$) considerable differences are revealed by the family of curves. The room space height vs. impurity concentration graphs present fairly horizontal parts $F_1$, $F_2$, $F_3$, the impurity concentration C increasing greatly at the said height locations in the room, $k_1$, $K_2$, $k_3$. The curves in the figure reveal that by changing the flow $Q_1$, $Q_2$, $Q_3$ the position of the curve sections $F_1$, $F_2$, $F_3$ in the room space can be influenced. Comparing the case of $Q_1$ with that of $Q_3$ we find that in the case of $Q_1$ the region $F_1$ is located at considerably greater height than the region $F_3$ in the case of $Q_3$. Thus with air flow $Q_1$ the impurity boundary layer is located high up in the upper part of the room. In the case of $Q_3$, again, the impurity boundary layer is located nearly in the staying zone, that is, the zone where its occurrence is meant to be prevented.

At the height position $k_2$ a measuring is applied to produce a measuring beam $S_2$, which in the case of $Q_2$ registers the presence of a boundary layer and presence of a region ($F_2$). When now the air flow rate is changed and the air flow becomes $Q_1$, the measuring means $R_2$ observes no boundary layer, as the boundary layer is located at height $k_1$.

It is also seen from FIG. 1 that when impurities are measured e.g. above the staying zone of the room e.g. at the point $R_2$, a great impurity concentration difference $C_3$–$C_1$ will be measured between the cases of $Q_1$ and $Q_3$. Therefore, at said point in the room space it is easy to measure with adequate accuracy the changes of impurity concentration and the gradient of change. Even minor air flow rate changes in the ventilation are observed as great changes of the impurity concentration. Thus, the control can be made accurate enough. It is also seen from the figure that measuring the concentration differences $C_3'$ and $C_1'$ at height position $R_o$ in the room space A would require remarkably precise measuring equipment; in any other case the control would be indefinite, or more accurate and more expensive measuring means would be required.

In FIG. 1B are shown the temperature graphs corresponding to the cases of $Q_1$, $Q_2$ and $Q_3$. The horizontal axis represents temperature and the vertical axis, the height in the room. The impurity concentration increases towards the upper part of the room space. The temperature also increase as shown in FIG. 1B. When temperature pick-ups are used for measuring means, temperatures $T_1$, $T_2$ and $T_3$ are measured at the height $R_2$ in the upper part of the room which are mutually markedly different. It is thus possible at said height in the hall space to observe even quite great temperature differences, which indicate changes of impurity concentration and/or changes in the air flow rate. It is thus possible by temperature measurement in the upper part of the staying zone to govern the control process in which the volumetric flow entering the room is changed in desired direction. In the air flow control said temperature pick-up may further be used to observe the temperature change due to increasing or decreasing the air flow. The pick-up observes without difficulty those changes of temperature which appear at said height in the room. No highly accurate recognition of the absolute value is required of the pick-up. On the other hand if temperature measurement has been implemented at the height $R_o$, considerable accuracy of the pick-up would have been demanded, and as a consequence the control process would be less accurate, or the measuring the control equipment in question would have to be specified to provide higher measuring accuracy of the absolute value of the measured quantity, which in its turn would imply higher cost. Occurrence of the impurity boundary layer is observed when an air impurity concentration surpassing a given value has been measured with the measuring means. Impurities are here understood to means comprehensively all undesirable particles in the air, for instance water vapour.

Figure 2:
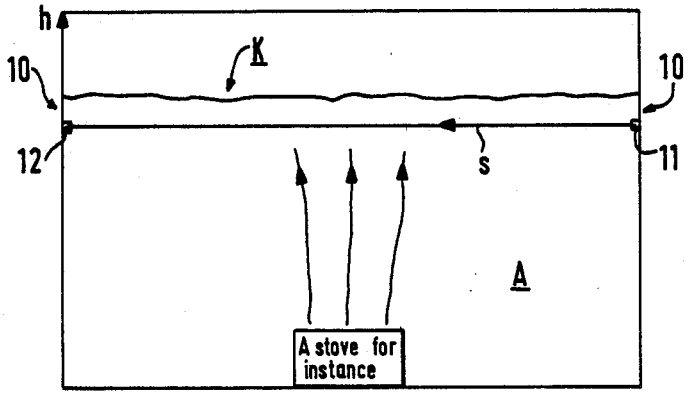
In FIG. 2 is illustrated measuring process in which measuring signal sent out by a transmitter means and received by a receiver means is employed. The air impurities in the hall space are measured with the aid of the measuring signal.

In FIG. 2 is depicted a measuring situation in which is used a measuring signal sent out by transmitter means and received by receiver means. The hall space has been schematically depicted in the figure. In the upper part of the hall space a boundary layer has become established, which has been denoted with K. For observing the location of said boundary layer K, and/or the air impurity quantities, means 10 is used. The measuring means 10 comprises, in an advantageous embodiment of the invention, a transmitter 11, which sends measuring signal s to a means 12. In the presentation of FIG. 2 the measuring signal has been disposed to run from the transmitter means 11 has been mounted on one wall of the hall space and the receiver means similarly on the opposite wall of the hall space.

The measuring signal 10 has been disposed to be located in the part of the room space A above the staying zone, and at the desired boundary layer height. If the ventilation is deficient or inadequate, the boundary layer K will descent into the staying zone and impurities will occur in the lower part of the room space in objectionable quantity. The measuring signal 10 indicates in the embodiment of FIG. 2 the location of said boundary layer in the room, and the measuring signal 10 supplies control further to the ventilation equipment to boost the ventilation.

Figure 3A:
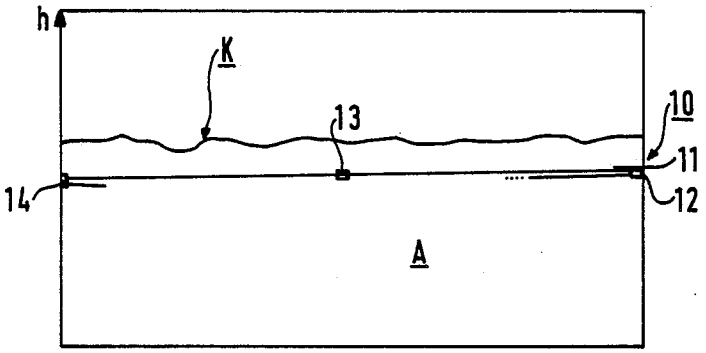
In FIG. 3A is depicted another measuring means arrangement, in which the measuring means has been disposed to measure the air impurities in the upper part of the staying zone in the hall space, in the way that the measuring signal has been disposed to pass through a plurality of reflection points before arriving at the receiver.

In FIG. 3A is depicted another arrangement regarding placement of the measuring means 10 in the room space A. In this embodiment of the invention the measuring signal s has been disposed to pass in the part of the room or hall space A above the staying zone over separate reflectors and in such manner that from the transmitter means 11 a measuring signal s is sent over reflectors 13,14,15 to receiver means 12 mounted on the same vertical wall.

Figure 3B:
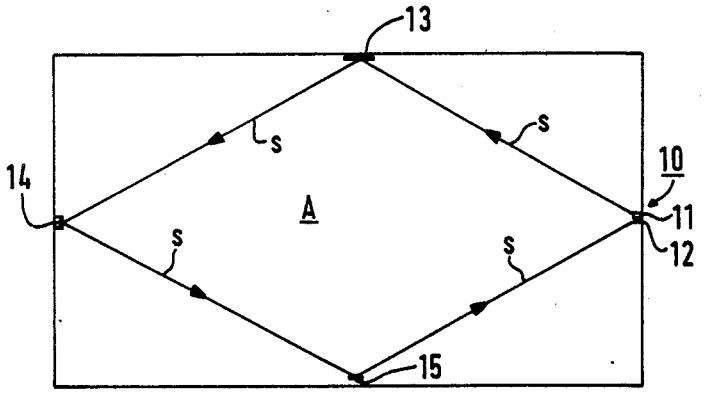
In FIG. 3B is shown the room space of FIG. 3A, seen from above.

In FIG. 3B the room space of FIG. 3A has been shown as viewed from above, and it is seen from the figure that the measuring signal s has been disposed to run over the reflector 13 on the wall to the wall which is opposite to the transmitter means 11 of the measuring means 10, and from the reflector 14 there provided to the side wall, and over the reflector 15 there provided, to the receiver means 12. The advantage of this reflection arrangement is that an accurate average of the impurities in the room is obtained. as the measuring signal is arranged to criss-cross as many times as possible through the measuring space for achievement of an accurate enough means result regarding the occurrence of the boundary layer and/or of impurities.

Figure 3C:
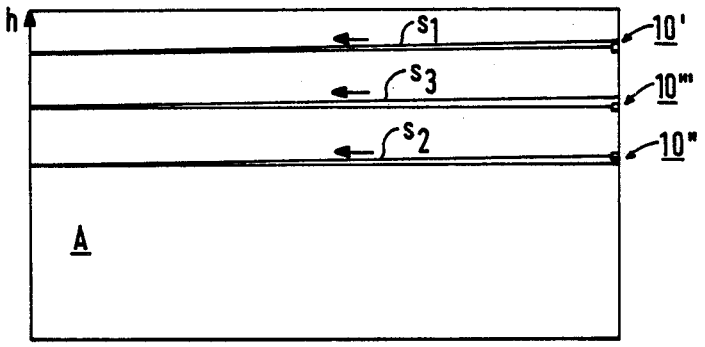
FIGS. 3C and 3D present other advantageous embodiments of the measuring arrangement.

FIG. 3C depicts embodiments of the invention. In FIG. 3C are depicted cases A and B. In case A two measuring means have been provided: measuring means 10' and 10''. The measuring means have been disposed at different heights in the room space and the measuring signals $s_1$ and $s_2$ have been arranged to run from one vertical wall of the room space over a reflector back to a receiver, and advantageously to receiver means disposed in immediate conjunction of the respective transmitter means. The receiver and transmitter have been disposed to be located on the same vertical wall. In this embodiment too, a plurality of reflectors may be used in order to obtain an accurate enough result of measurement. In case A, measuring means 10' and 10'' have been disposed substantially in the region of occurrence of the impurity layer in the upper part of the room space, above the staying zone. The lower of the two measuring means, 10'', has been arranged to indicate that lowest limit below which the boundary layer must not extend, and the measuring means 10' has been arranged to indicate that upper limit above which the boundary layer need not go. Thus with the air of the means 10' and 10'' the ventilation and the air entering the room are controlled so that the boundary layer has been arranged to be within a given range between the measuring means 10' and 10''. Since the impurity difference is great between the 10' measuring level and the 10'' measuring level, it is even easier to measure.

In FIG. 3C is also displayed a case in which only one measuring means 10''' is used, which has been arranged to produce a measuring signal $s_3$. When this single measuring means 10''' is used, the measuring means is likewise disposed above the staying zone, in the region of occurrence of the impurity layer. The measuring means 10''' may be disposed in the very highest part of the room space to indicate that upper limit above which the boundary layer need not reach. The measuring means 10''' may also be disposed to be located in the staying zone in such manner that it has been arranged to indicate the limit below which the boundary layer must not extend under any circumstances.

Figure 3D:
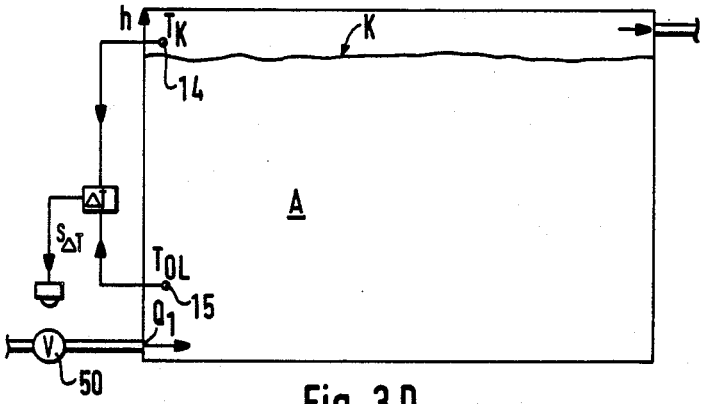

In FIG. 3D is depicted another advantageous embodiment of the invention in which the measuring means 10 consists of two temperature pick-ups 14 and 15 observing the occurrence of the boundary layer K. At least one first pick-up 14 is used, disposed in the upper part of the hall space, to measure the temperature (Tk) prevailing there, and at least one second pick-up 15 is used, disposed to measure the temperature ($T_{OL}$) in the staying zone. The ventilation of the room space is controlled on the basis of the differential temperature $\Delta t$ between the upper part of the room space and the staying zone in the room space, measured with the measuring means, i.e., measured by the pick-ups. This control is carried out in direct accordance with the differential temperature $\Delta t$, that is, when $\Delta t$ increase, the amount of fresh air introduced in the room is increased, i.e., the displacement air quantity is increased; similarly, when the differential temperature $\Delta t$ becomes less, such ventilation control is caused that the fresh air quantity introduced in the room becomes less. On the basis of the differential temperature $\Delta t$ a control signal $S_{\Delta t}$ is produced by which the air $Q_1$ is controlled which the blower 50 forces into the room space A.

In the procedure of the invention one or several transmitter means 11 and one or several receiver means 12 may be used, with which the measurement has been arranged to take place on different levels, as related to the room space height, whereby the impurity concentration and/or the impurity concentration differences between different levels are observed.

In the procedure of the invention a pick-up indicating given impurities, and specific impurities as desired, may be used, and which has been disposed to be located in or adjacent to the region of occurrence of the impurity boundary layer of the upper level of the staying zone in the room or hall space. As taught by the invention, said pick-up is disposed to measure the impurity concentration and/or humidity of the air at a given punctiform spot above the staying zone in the room or equivalent.

As taught by the invention, the pick-up may be disposed to measure at that height in the room space above or at a below which the occurrence e.g. of smoke impurities is permitted, in which case depending on said positioning of the pick-up and on the values which the pick-up registers the location of the impurity layer in the room space is controlled.

Figure 4:
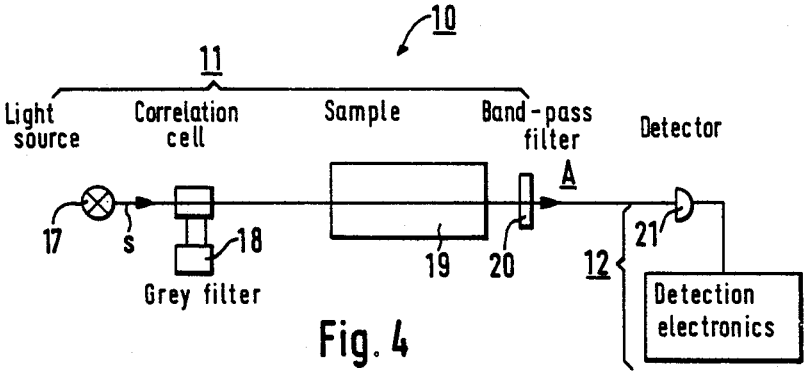
In FIG. 4 is illustrated the use of a measuring signal, advantageously an infrared signal, in the ventilation control procedure. The apparatus design has been shown schematically.

In FIG. 4 is presented the use of an infrared signal in the ventilation control procedure. The apparatus design has also been schematically depicted.

In FIG. 4, a light source 17 sends out the infrared signal s, or a measuring signal s indicating occurrence of impurities, through a correlation cell and grey filter 18, through reference means 19, and through a band-pass filter 20 into the room space A. After traversing the air space of the room A, the measuring signal s is received with receiver means 12, and here with a special detector 21. The receiver means 12 comprises separately an electronic unit processing the incoming signal. The reference unit 19 comprises a sample of the substance the occurrence of which in the room space one desires to measure.

The result of measurement which is obtained is a so-called transmission spectrum, as a function of wavelength. In the process a reference signal spectrum as well as a measuring signal spectrum is produced, and the difference of the two spectra shows the part of the signal which has been absorbed by certain impurities in the air. The higher this absorption, the greater has been the amount of impurity particles in the air.

With the apparatus arrangement of FIG. 4, the occurrence in the air of the room space of different impurities can be measured. It follows that with the apparatus arrangement of the invention it is possible to control the ventilation in dependence of the presence of given impurities in the room.

For measuring signal s may be used both an ultrasonic signal, visible light, infrared light and any other partial range of the electromagnetic radiation spectrum.

Figure 5:
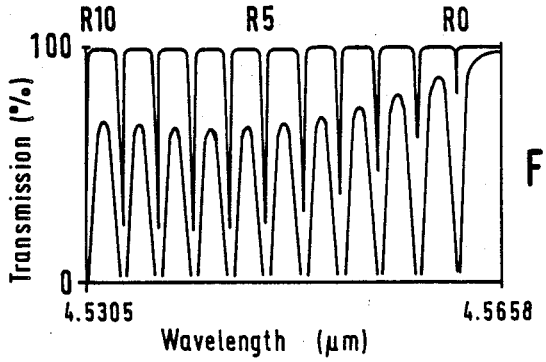
In FIG. 5 are displayed the spectra of the reference signal and measuring signal, plotted over wavelength.

In FIG. 5 the spectra of the reference signal and measuring signal are displayed, plotted over wavelength. The difference between the two spectra shows the measuring signal intensity absorbed by impurities, as a function of wavelength; in other words: the higher the absorption of the measuring signal in the impurities, the greater is the difference in the spectral level of the reference signal and the measured spectral level. The ventilation process can be controlled on the basis of this difference. In an advantageous embodiment of the invention, which has not been shown by any figure, the occurrence of the boundary layer is measured in the part of the room or hall space outside the staying zone, using a separate pick-up indicating impurities, advantageously a ceramic pick-up. The pick-up may equally be a pick-up responding to humidity. Said pick-ups are disposed in the upper part of the staying zone in the room, in the region where the boundary layer occurs. When the ceramic pick-up registers the presence of certain amount of impurities, a loading means connected to the pick-up directs the action of the ventilation control apparatus.

The measuring means may advantageously be means producing radiation, advantageously means producing electromagnetic radiation which produces measuring radiation within a wide frequency range. This radiation is received with receiver means, and the receiver receiving said wide-band radiation may advantageously comprise means for examining a given radiation frequency range, whereby with said means each air impurity can be separately examined.

To summarize, the present invention is directed to a displacement ventilation control procedure, in which the impurity and/or humidity concentration of the air containing impurities which accumulates in the part of the room or hall space above the staying zone and/or the changes thereof and/or the differences thereof are observed, and the ventilation of the room or hall space is controlled in accordance therewith. More particularly, the occurrence of the impurity boundary layer and/or the air humidity boundary layer is observed above the staying zone in the room space, and when the impurity boundary layer descends below a given limiting height, the air flow entering the room is increased, and/or when the impurity boundary layer extends above a given upper limit, the amount of fresh air entering the room is reduced, with measuring means being used herein which have been disposed to observe the location of the boundary layer above the staying zone, whereby comparatively low absolute value measuring accuracy is required of the measuring means, for implementing the control process.

More specifically, measuring means 10 is used which have been disposed to produce a measuring signal s from transmitter means 11, the measuring signal being disposed to pass through the impurities above the staying zone in the room space, to receiver means 12. Preferably, the measuring signal is disposed to travel over at lest one reflector before proceeding to the receiver means. The transmitter means 11 is preferably disposed to produce and send out a measuring signal s substantially in the horizontal plane in the room space above, at, or below which occurrence, e.g. of a smoke or impurity layer, is permitted. The location of the impurity layer in the room space is controlled depending upon the pick-up positioning and of the values which the pick-up registers.

One or several transmitter means 11 and one or several receiver means 12 may be employed in the procedure of the present invention, by which the measurement is arranged to take place in different planes relative to room height, the impurity concentration and/or differences in impurity concentration between different planes being observed.

Preferably, an infrared signal is used for the measuring signals s which is disposed to run in the room space, and with the absorption of the measuring signal by the impurities in the air being observed, and the ventilation being controlled on the basis of the absorption. Also, in the measuring process, intensity measurement of the measuring signal may be applied, with the intensity of the measuring signal being measured above the staying zone. Furthermore, at least one first pick-up 14 may be used for the measuring means 10, and disposed to measure the temperature in the upper part of the room or hall space, while at least one second pick-up 15 may be disposed to measure the temperature in the staying zone of the room space or equivalent. The ventilation of the room space is thereby controlled by the aid of the temperature difference $\Delta t$ of the temperatures measured by the pick ups 14 and 15. The air flow introduced into the room is increased when this differential temperature $\Delta t$ increases, or the amount of fresh air introduced into the room is reduced when the differential temperature $\Delta t$ decreases.

A pick-up indicating given and desired impurities and which is disposed to be located in or adjacent to the region of occurrence of the impurity boundary layer in the upper part of the staying zone in the room or hall space, may be used. Furthermore, measuring means may be used which have been disposed to measure the impurity concentration and/or humidity of the air at a given punctiform spot above the staying zone in the room or equivalent, with a measuring pick-up being advantageously used. This measuring means 10, being a measuring pick-up, are disposed to measure at that height in the room space above, at, a below which the occurrence, e.g. of smoke impurity, is permitted, the location of the impurity layer being controlled depending on the location of the pick-up and of the values registered by the pick-up.

Furthermore, measuring means 10 may be used which are disposed to send out radiation in various frequency ranges, with receiver means being provided by the aid of which the occurrence in the air space above the staying zone in the room space of a given impurity is examined, and which constitutes the object under examination. In this procedure, each given frequency band of the radiation sent out with the measuring means 10 being examined, corresponds to a given impurity and its occurrence in the air space.

The present invention is also directed to ventilation control means comprising transmitter means 11 disposed to send out a measuring signal s into a room space A, the measuring signal s being disposed to travel in the air in the room space and part of the measuring signal being arranged to be absorbed by impurities in the air in the room space, along with receiver means which indicate the absorption fraction. The ventilation of the room space is controlled according to the amount of impurity, in desired manner.

More specifically, the control means comprise at least one reflector disposed to reflect the measuring signal s either directly to the receiver means or over one or several reflectors to the receiver means 12. The ventilation control means may comprise transmitter means 17 producing an infrared signal and receiver means 21 receiving the signal s which produce the spectra of the measuring and reference signals as a function of wavelength. The difference between the radiation levels of the spectra are used to indirectly control the ventilation process of the room space.

More specifically, the control means may comprise at least one first temperature pick-up 14 disposed in an upper part of the room space and at least one second temperature pick-up 15 disposed in a staying zone in the room. Means have been separately provided for calculating the difference of the temperatures registered by these pick-ups, there being provided means by which the ventilation process of the room space is controlled on the basis of differential temperature $\Delta t$ thus found. The control means may comprise a measuring pick-up measuring at a punctiform spot, the humidity and/or the impurity concentration in the air space.

Furthermore, the measuring means 10 may be a radiation-producing means which produce measuring radiation, advantageously electromagnetic radiation within a wide frequency range. The means observing the boundary layer may be a receiver for receiving the wide-band radiation emitted by the measuring means 10 and comprising means for examining a given radiation frequency range, whereby with the aid of this means, each impurity in the air can be separately examined.

We claim:

1. A displacement ventilation method wherein the first air is introduced into a room space or equivalent chamber, and in which impure air is removed from an upper part of said room space or equivalent chamber from above an impurity boundary layer created in said room space or equivalent chamber, comprising the steps of observing occurrence of said impurity boundary layer above a staying zone within said room space or equivalent chamber, when said impurity boundary layer descends below a given limiting height in said space of chamber, increasing air flow entering into said space or chamber, when said impurity boundary layer rises above a given upper limit within said space or chamber, reducing amount of fresh air entering into said space of chamber, and disposing measuring means for observing location of said boundary layer above said staying zone for carrying out said observing step, whereby comparatively low absolute value measuring accuracy is required for implementing and controlling said displacement ventilation method.

2. The method of claim 1, comprising the additional steps of disposing transmitter means for generating a measuring signal arranged to pass through impurities above said staying zone in said room space or chamber, and disposing receiver means for receiving said measuring signal, said transmitter and receiver means constituting said measuring means.

3. The method of claim 2, comprising the additional step of disposing said measuring signal to travel over at least one reflector before proceeding to said receiver means.

4. The method of claim 1, comprising the additional step of disposing as said measuring means, transmitter means for producing and emitting a measuring signal substantially in a horizontal plane in said room space of chamber above, at, or below which occurrence of an impurity layer is permitted, and controlling location of said impurity layer in said space or chamber depending upon positioning of a pick-up, and upon values which said pick-up register.

5. The method of claim 1, comprising the additional step of employing, as said measuring means, one or several transmitter means and one or several receiver means, with which measuring has been arranged to take place at different planes relative to height of said space or chamber, and observing at least one of impurity concentration and differences in impurity concentration between said different planes.

6. The method of claim 1, comprising the additional step of disposing, as a measuring signal from said measuring means, an infrared signal to run in said room space or equivalent chamber, observing absorption of said measuring signal by impurities in the air within said space or chamber, and controlling ventilation based upon degree of said absorption of said infrared signal.

7. The method of claim 1, comprising the additional step of applying intensity measurement of a measuring signal from said measuring means, and measuring said intensity of said measuring signal above said staying zone.

8. The method of claim 1, comprising the additional step of disposing, as said measuring means, at least one first pick-up to measure temperature in an upper part of said space or chamber, and at least one second pick-up disposed to measure the temperature in said staying zone of said space of chamber, controlling ventilation of said space of chamber with the aid of difference of temperatures measured by said first and second pick-ups, increasing said air flow introduced into said room or chamber when said differential temperature increases, and reducing said air flow into said space or chamber when said differential temperature decreases.

9. The method of claim 1, comprising the additional step of using, as said measuring means, a pick-up indicating given, desired impurities, and disposing said pick-up to be located in or adjacent to a region of occurrence of said impurity boundary layer in an upper part of said staying zone in the space of chamber.

10. The method of claim 1, comprising the additional step of disposing said measuring means to measure at least one of impurity concentration and humidity of air at a given punctiform spot above said staying zone in said room or chamber.

11. The method of claim 10, comprising the additional step of utilizing, as said measuring means, a measuring pick-up.

12. The method of claim 11, comprising the additional step of disposing said measuring pick-up at a height in said space or chamber above, at, or below which occurrence of impurity is permitted, and controlling location of said impurity layer depending upon said location of said pick-up and upon values registered by said pick-up.

13. The method of claim 3, comprising the additional steps of arranging, as said measuring means, a transmitter and a receiver on opposite walls of said space or chamber from one another, and arranging two reflectors on opposite walls of said space of chamber from one another, and arranging for said measuring signal to run and be reflected by said two reflectors, whereby said measuring signal is arranged to criss-cross said space or chamber as much as possible, for achieving a sufficiently accurate measuring result regarding occurrence of said boundary layer or of said impurities.

14. The method of claim 1, wherein said boundary layer is observed by detecting at least one of humidity within said space or chamber, change of temperature within said space or chamber, and impurity content within said space or chamber.

15. The method of claim 14, wherein said boundary layer is observed by detecting difference in temperature between an upper part of said space or chamber and a lower part of said space or chamber, and comprising the additional steps of increasing ventilation of said space of chamber when said temperature difference increases, and decreasing ventilation of said space of chamber when said temperature difference decreases.

* * * * *